United States Patent [19]

Linder

[11] Patent Number: 4,494,705

[45] Date of Patent: Jan. 22, 1985

[54] METHOD AND APPARATUS FOR TRANSPORTING AND STORING PAPER SHEETS AND THE LIKE

[75] Inventor: Heinz Linder, Zofingen, Switzerland

[73] Assignee: Grapha-Holding AG, Hergiswil, Switzerland

[21] Appl. No.: 469,925

[22] Filed: Feb. 25, 1983

[30] Foreign Application Priority Data

Mar. 30, 1982 [CH] Switzerland ..... 1934/82

[51] Int. Cl.[3] ..... B65H 29/70

[52] U.S. Cl. ..... 242/59; 198/423

[58] Field of Search ..... 271/151, 202, 216, 303; 242/59, 55, 67.3 R, 55.2; 270/52, 54, 56; 53/118, 430; 198/347, 423; 226/76

[56] References Cited

U.S. PATENT DOCUMENTS

| | | | |
|---|---|---|---|
| 789,707 | 5/1905 | Bellamy | 242/59 |
| 4,007,824 | 2/1977 | Reist | 198/423 X |

FOREIGN PATENT DOCUMENTS

| | | | |
|---|---|---|---|
| 0054735 | 10/1981 | European Pat. Off. | 53/118 |
| 2426217 | 12/1974 | Fed. Rep. of Germany | 271/303 |
| 559691 | 3/1975 | Switzerland | 53/118 |
| 2092557 | 2/1981 | United Kingdom | 53/118 |

*Primary Examiner*—Stuart S. Levy
*Assistant Examiner*—Katherine Jaekel
*Attorney, Agent, or Firm*—Peter K. Kontler

[57] ABSTRACT

A scalloped stream of paper sheets is intermittently transported from a sheet feeding unit to a reservoir wherein one portion of a flexible elastic band convolutes the sheets around a core. The sheets are thereupon transported over a switchover device and onto another portion of the band which convolutes the sheets around a hub while the core pays out the one portion of the band. If the sheets are needed at one or more consuming stations, the hub is rotated in a direction to pay out the other portion of the band and the switchover device directs successive sheets from the other portion of the band into or onto a sheet removing unit. The switchover device and the one portion of the band define a first transfer station where the sheets coming from the feeding unit reach the upper side of the one portion of the band and where the sheets leave the one portion of the band on their way toward and onto the other portion of the band. The other portion of the band and the switchover device define a second transfer station where the sheets coming from the one band portion and advancing over certain conveyors of the switchover device reach the other band portion and where the sheets leave the other band portion on their way over a conveyor of the switchover device and to the sheet removing unit. When the core pays out the one portion of the band, the hub collects the other portion of the band, and vice versa.

18 Claims, 5 Drawing Figures

METHOD AND APPARATUS FOR TRANSPORTING AND STORING PAPER SHEETS AND THE LIKE

BACKGROUND OF THE INVENTION

The present invention relates to a method and apparatus for transporting and storing sheets which consist of paper or the like. More particularly, the invention relates to improvements in a method and apparatus for the transport and temporary storage of scalloped streams of sheets wherein the sheets partially overlap each other. Still more particularly, the invention relates to improvements in apparatus wherein a rotary hub is connected with a flexible element and the latter can be coiled around the hub to thereby store sheets between its convolutions, or uncoiled from the hub to thereby remove sheets from the locus of temporary storage around the hub.

An apparatus of the just outlined character is disclosed, for example, in U.S. Pat. No. 1,838,065. A drawback of the patented apparatus is that the scalloped stream of sheets which are removed from the locus of storage in the region around the rotatable hub cannot be readily processed because they overlap each other in the wrong way, namely, each preceding sheet of the stream which is removed from storage overlaps the next-following sheet. Successive sheets of such a scalloped stream cannot be readily stacked in a duct or the like (e.g., in the magazine of a gathering machine), and successive sheets of such stream cannot be transferred from a preceding conveyor onto a next-following conveyor.

It was also proposed to invert the scalloped stream through 180° prior to delivery into the range of the flexible element, i.e., prior to coiling of sheets around the hub while the latter rotates in a direction to collect the flexible element. The inversion takes place about an axis which extends in the longitudinal direction of the scalloped stream. This eliminates the aforediscussed problem, i.e., each preceding sheet of the stream which is removed from storage on the hub is overlapped by the next-following sheet. However, the inversion can create other serious problems, for example, when only one side of each sheet carries printed matter or when the two sides of a sheet carry different printed matter. This scrambles the sequence of pages on sheets which are to be assembled into pamphlets, books or like products.

OBJECTS AND SUMMARY OF THE INVENTION

An object of the invention is to provide a novel and improved apparatus which can temporarily store a large number of sheets in a small area and in such a way that the sheets which are withdrawn from storage are in optimum positions for further processing.

Another object of the invention is to provide an apparatus which ensures that the sheets are in optimum positions for further processing immediately after removal from temporary storage, even though no inversion of the stream takes place prior to delivery of sheets into storage.

A further object of the invention is to provide an apparatus of the above outlined character which ensures that all of the sheets which are removed from temporary storage are in an optimum orientation for gathering into signatures, books, pamphlets or the like.

An additional object of the invention is to provide novel and improved drive means for the moving parts of the improved apparatus.

Another object of the invention is to provide the apparatus with novel and improved means for manipulating the sheets of a scalloped stream on their way into a temporary storing facility in the space around the periphery of a rotary member.

An additional object of the invention is to provide the apparatus with novel and improved means for directing the flow of sheets from one or more sources, through several storing facilities, and to one or more consuming or processing stations.

A further object of the invention is to provide a relatively simple, compact and inexpensive apparatus which can be used for the transport and temporary storage of a wide variety of sheets including stiff, soft, wide, narrow, short, long, blank, imprinted, folded, unfolded, discrete or multi-ply or multi-layer sheets.

An additional object of the invention is to provide a novel and improved method of manipulating and temporarily storing scalloped streams of partly overlapping paper sheets on their way from one or more sources to one or more consumers.

One feature of the invention resides in the provision of an apparatus for manipulating sheets which consist of paper or the like, particularly for manipulating paper sheets which form a scalloped stream. The apparatus comprises sheet feeding means and sheet stacking or storing means including a hub, a flexible element having an end portion which is secured to the hub, means for rotating the hub in opposite directions so that the hub can collect or pay out the flexible element, and guide means defining a first path along which a portion of the flexible element advances in response to rotation of the hub. The apparatus further comprises a reservoir which constitutes a second storing means, and sheet directing means which is disposed intermediate the reservoir and the first path. Such sheet directing means includes means for completing and opening a second path along which the sheets can advance from the feeding means into the reservoir, and means for completing and opening a third path along which the sheets can advance from the reservoir into the first path so that the flexible element can convolute the sheets around the hub in response to rotation of the hub in a direction to collect the flexible element.

The apparatus further comprises sheet removing means, and the sheet directing means further comprises means for completing and opening a fourth path which connects the first path with the removing means and along which the sheets advance from the hub to the removing means in response to rotation of the hub in a direction to pay out the flexible element. The sheet directing means and the reservoir can be said to define a first junction or transfer station which connects the reservoir with the second path, and the sheet directing means defines with the flexible element a second junction or transfer station which connects the first path with the third path.

The aforementioned reservoir preferably comprises a core, a second flexible element an end portion of which is connected to the core, means for rotating the core in opposite directions (clockwise and counter-clockwise) so that the core can collect or pay out the second flexible element, and second guide means defining for the second flexible element an additional path which communicates with the feeding means in response to completion of and along the second path or with the first path in response to completion of and along the third path. The aforementioned second junction or transfer station is defined by the sheet directing means jointly with the flexible element of the stacking means to connect the removing means with the first path in response to completion of and along the fourth path.

The two flexible elements can constitute portions of one and the same elongated band, and the additional path then constitutes an extension of the first path.

The aforementioned sheet directing means can constitute a switchover device having parts movable between first positions in which the second and third paths are respectively completed and open, and second positions in which the second and third paths are respectively open and completed, i.e., the third path is open when the second path is completed and vice versa. The fourth path can be completed simultaneously with completion of the second path, i.e., the fourth path is open when the third path is completed and vice versa.

The hub is preferably disposed at a level above the first path, i.e., the first flexible element can be convoluted onto the hub from below so that its upper side carries sheets from the reservoir into storage around the hub and that such upper side carries sheets from the storage around the hub toward and into the fourth path along which the sheets advance to the receiving means. Analogously, the core of the reservoir is preferably disposed above the additional path, i.e., the upper side of the second flexible element convolutes sheets around the core when the latter is rotated in a direction to collect the second flexible element, and the upper side of the second flexible element transports sheets from the core into the third path in response to such rotation of the core that the latter pays out the second flexible element.

The flexible element or elements preferably consist of an elastomeric material. It has been found that the elasticity of each flexible element is highly satisfactory if its length is increased by at least one-tenth of one percent (preferably between 0.5 and 1 percent) in response to the application of a tensional stress in the order of between 0.5 and 1.5 $kg/mm^2$, e.g., approximately 1 $kg/mm^2$.

The apparatus can further comprise a plurality of sheet supplying means each of which is operable to deliver sheets to the feeding means, drive means and means for coupling selected sheet supplying means with the drive means so that the selected sheet supplying means is or are then operative to deliver sheets to the feeding means. Still further, the apparatus can comprise a plurality of sheet distributing means which are operable to receive sheets from the removing means, drive means, and means for coupling selected sheet distributing means to the drive means so that the selected sheet distributing means is or are then operative to receive sheets from the removing means and to advance such sheets to their destination, e.g., to a cross-stacker or to the magazine of a gathering machine.

The arrangement can be such that the feeding means delivers sheets in a first direction, that the flexible element or elements are arranged to transport sheets in a second direction substantially at right angles to the first direction, and that the direction of transport of sheets from the feeding means to the reservoir is counter to the direction of transport of sheets from the reservoir to the flexible element of the stacking means. This ensures that, if the relative positions of sheets in the stream which advances from the feeding means to the reservoir are satisfactory, the relative positions of such sheets are unsatisfactory or less satisfactory during transport from the reservoir to the stacking means, and the relative positions of sheets are again satisfactory during transport from the stacking means to the removing means.

Another feature of the invention resides in the provision of a method of manipulating sheets which consist of paper or the like. The method comprises the steps of feeding sheets at desired or required intervals along a first path (corresponding to the aforementioned second path), temporarily storing the sheets at a first location (on the core) including conveying the sheets (by the second flexible element) from the first path into a first spiral path (defined by the second flexible element around the core of the reservoir) wherein the sheets form a succession of convolutions with each next-following convolution surrounding the preceding convolution, temporarily storing the sheets at a second location (on the hub) including conveying the sheets from successive outermost convolutions of the first spiral path into a second spiral path (defined by the first flexible element around the hub of the stacking means) wherein the sheets of the aforementioned next-following convolutions are surrounded by the sheets of the respective preceding convolutions, and removing the sheets from the second location (around the hub) including conveying the sheets from the second spiral path along a further path (corresponding to the aforediscussed fourth path).

The sheets in the first spiral path preferably form a first scalloped stream wherein each next-following sheet partially overlies the preceding sheet, the sheets in the second spiral path can form a second scalloped stream wherein each preceding sheet partly overlies the next-following sheet, and the sheets in the additional path preferably form a third scalloped stream wherein each next-following sheet partially overlies the preceding sheet.

The method is preferably practiced in such a way that the conveying of sheets into the first spiral path is interrupted during conveying of sheets into the second spiral path, and that the conveying of sheets from the first into the second spiral path is interrupted during conveying of sheets from the second spiral path into the additional path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
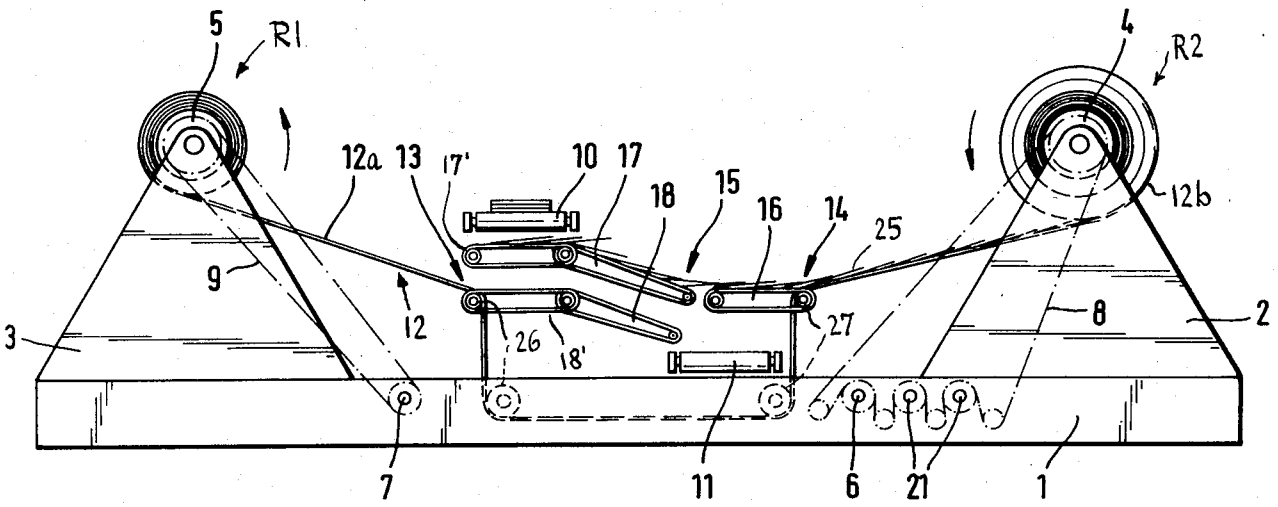
FIG. 1 is a schematic elevational view of an apparatus which embodies one form of the invention, with the movable parts of the switchover device shown in positions they assume during conveying of a scalloped stream of sheets from the feeding means into the reservoir.

Referring first to FIG. 1, there is shown a sheet transporting and storing apparatus which comprises a main support or base 1 for a first pair of bearing members 2 and a second pair of bearing members 3. The bearing members 2 are disposed at the opposite axial ends of and support a core 4 so that the latter is rotatable about a horizontal axis, and the bearing members 3 are disposed at the opposite axial ends of and support a hub 5 which is also rotatable about a horizontal axis. The axes of the core 4 and hub 5 are preferably parallel to one another. The hub 5 forms part of a sheet stacking or storing device R1 which serves for temporary storage of paper sheets 25 and further comprises an elastically deformable flexible element 12*a* one end portion of which is secured to the hub 5, means for rotating the hub 5 clockwise or counterclockwise (such rotating means includes a shaft 7 which is rotatable by a reversible motor M shown in FIG. 5 and a chain or toothed belt drive 9 which is indicated in FIG. 1 by phantom lines), and guide means for the flexible element 12*a*. The guide means for the flexible element 12*a* comprises one or more rollers, pulleys or wheels 26 which are mounted in or on the support 1 to define for the flexible element 12*a* an elongated (first) path wherein the element 12*a* can move back and forth, depending on the direction of rotation of the shaft 7.

The core 4 forms part of a reservoir R2 for paper sheets 25, and this reservoir further includes a second elastic flexible element 12*b* one end portion of which is secured to the core 4, means for rotating the core in a clockwise or in a counterclockwise direction (the illustrated rotating means includes a shaft 6 which is rotatably installed in the support 1 and is driven by a reversible motor, not shown, and a chain drive 8 which transmits torque from the shaft 6 to the core 4), and guide means including one or more pulleys 27 or analogous rotary elements which define for the flexible element 12*b* an elongated (additional) path wherein the flexible element 12*b* can move back and forth, depending on the direction of rotation of the shaft 6. In the illustrated apparatus, the flexible elements 12*a* and 12*b* constitute two sections or parts of one and the same elongated elastic band 12, i.e., the first path constitutes an extension of the additional path and vice versa. The arrangement is such that the shaft 7 drives the hub 5 in a clockwise direction (whereby the hub 5 collects the flexible element 12*a*) when the core 4 rotates in a clockwise direction to pay out the flexible element 12*b*, and vice versa.

The band 12 is sufficiently elastic to be capable of undergoing at least some elongation in response to the application of a tensional stress. The elasticity of the band 12 is preferably such that its length increases by at least one-tenth of one percent in response to the application of a tensional stress in the range of 0.5 to 1.5 kg/mm$^2$, most preferably an elongation of between 0.5 and 1 percent in response to the application of a tensional stress of, for example, 1 kg/mm$^2$.

The apparatus further comprises a sheet feeding unit 10 (e.g., an endless belt conveyor whose upper reach can deliver a succession of sheets 25 in a direction at right angles to the plane of FIG. 1), and a sheet removing unit 11 which is disposed at a level below the feeding unit 10 and also comprises (or can also comprise) an endless belt conveyor whose upper reach can receive successive sheets of a scalloped stream coming from the stacking device R1 and advancing in a direction at right angles to the direction of travel of sheets in the unit 10 or 11.

Still further, the apparatus comprises a sheet directing means in the form of a switchover device 15 which is mounted on the support 1 between the stacking device R1 and the reservoir R2. This switchover device 15 is installed between the levels of the sheet feeding unit 10 and sheet removing unit 11 and includes a set of conveyors (e.g., endless band or belt conveyors) 16, 17, 17', 18 and 18' which perform a plurality of functions and three of which (namely, the conveyors 16, 18 and 18') can be driven in opposite directions in a manner not specifically shown in the drawing. When the conveyors 17 and 18 assume the angular positions which are shown in FIG. 1, the upper reach of the conveyor 17 can receive successive sheets 25 of a scalloped stream which is supplied by the feeding unit 10, and the conveyor 16 can deliver such sheets onto the upper side of the flexible element 12*b* at a junction or transfer station 14. At such time, the shaft 6 drives the core 4 in a counterclockwise direction so that the flexible element 12*b* is coiled around the core 4 and causes the sheets 25 of the scalloped stream to form convolutions around the core. It can be said that the flexible element 12*b* then defines a spiral path which surrounds the core 4 and wherein the sheets 25 coming from the conveyor 16 at the junction 14 are temporarily stored while the hub 5 rotates in a counterclockwise direction to pay out the flexible element 12*a*. The conveyors 17 and 16 of the switchover device 15 then complete a (second) path which extends from the feeding unit 10 to the junction 14 and enables the sheets 25 to advance onto the upper side of the flexible element 12*b* (i.e., into the additional path) and into the reservoir R2.

Figure 2:
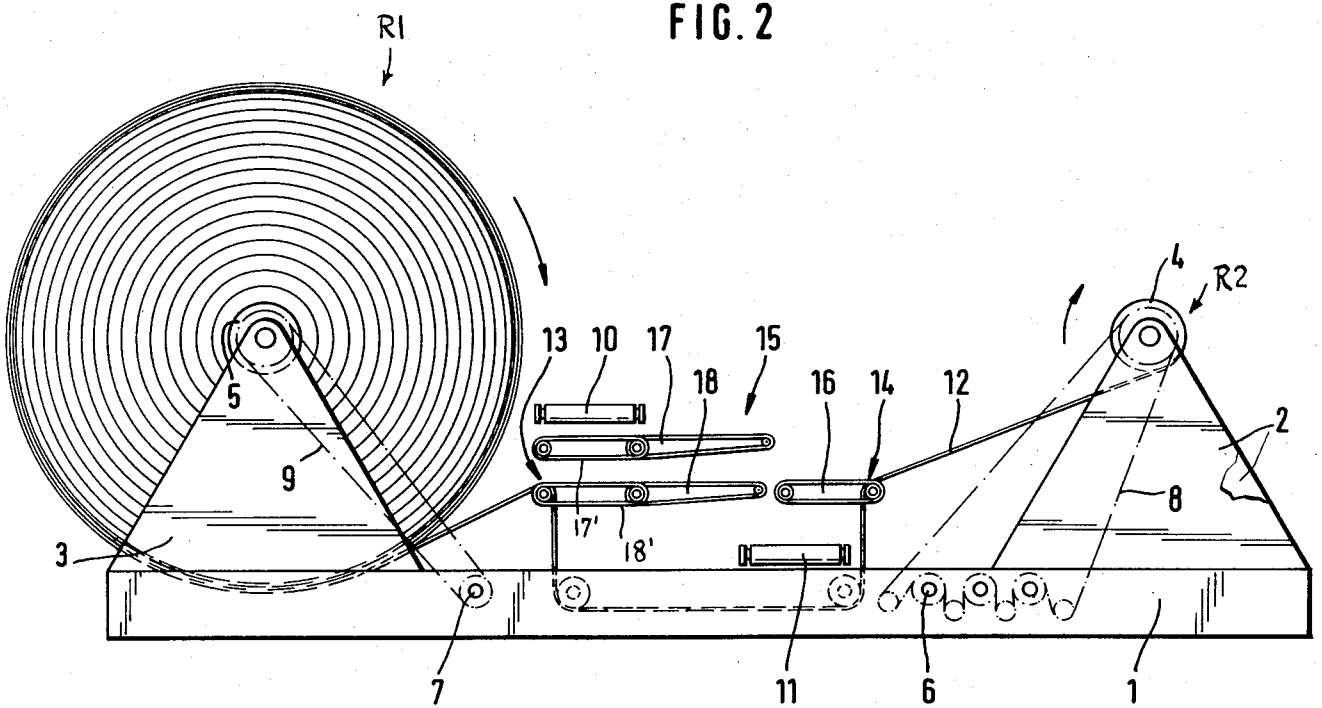
FIG. 2 is a similar schematic elevational view, showing the movable parts of the switchover device in positions they assume during and immediately after completion of transport of a scalloped stream from the reservoir to the stacking means.

When the conveyors 17 and 18 of the switchover device 15 are moved to the positions which are shown in FIG. 2, the second path is open because the right-hand end turn of the conveyor 17 is lifted above the left-hand end turn of the conveyor 16 but the conveyors 16, 18 of the switchover device 15 then complete a (third) path along which the sheets 25 can advance from the reservoir R2 into the first path, namely, onto the upper side of the flexible element 12*a* at a second junction or transfer station 13 which accommodates one of the pulleys 26 for the flexible element 12*a*. If the hub 5 is then rotated clockwise so as to collect the flexible element 12*a*, while the core 4 is rotated in a clockwise direction to pay out the flexible element 12*b*, the scalloped stream of sheets 25 which were temporarily stored in the reservoir R2 is transferred into the stacking device R1 wherein the sheets are convoluted around the hub 5 in such a way that each preceding sheet 25 overlies a portion of the next-following sheet. The manner of storing the sheets 25 in the reservoir R2 is such that each preceding sheet is partially overlapped by the next-following sheet. It can be said that the flexible element 12*a* then defines a spiral path which surrounds the hub 5 and stores a convoluted scalloped stream of sheets 25. This is shown in FIG. 2. It is to be noted that, at the start of transport and temporary storage of sheets 25 in the reservoir R2 and stacking means R1, a certain length of the flexible element 12*a*, e.g., approximately one-half of the band 12, is convoluted around the hub 5 so that the latter can pay out the flexible element 12*a* while the flexible element 12*b* is being convoluted onto the core 4 to define a spiral path therearound. When the transfer of sheets 25 from the reservoir R2 into the stacking device R1 is completed, the core 4 and the hub 5 continue to rotate in a clockwise direction so that at least the major part of the band 12 is convoluted onto the hub 5.

If the operator thereupon wishes to advance sheets from temporary storage on the hub 5 of the stacking device R1 onto the upper reach of the conveyor forming part of the removing unit 11, the conveyors 17, 18 of the switchover device 15 are returned to the positions of FIG. 1 (see also FIG. 3) so that the conveyor 18 can deliver sheets from the junction 14 to the removing unit 11 while the core 4 rotates counterclockwise to collect the flexible element 12*b* and the hub 5 also rotates in a counterclockwise direction to pay out the flexible element 12*a*. The conveyor 18 then defines a (fourth) path along which the sheets 25 can advance from the junction 14 onto the conveyor of the removing unit 11. At the same time, the reservoir R2 receives sheets 25 from the feeding unit 10 along the completed second path (conveyors 17', 17, 16), through the junction 14 and along the upper side of the flexible element 12*b*. Filling of the reservoir R2 (see FIG. 3) precedes the transfer of sheets from the device R1 onto the removing unit 11 because a length of the convoluted flexible element 12*b* surrounds the sheets 25 which are stored in the device R1 and such length must be transferred onto the core 4 before the flexible element 12*a* can deliver sheets 25 to the conveyor 18' at the junction 13.

The inclination of the conveyor 16 (whose endless band or bands can move in two directions) need not be changed at all. The same holds true for a conveyor 17' which is disposed directly below the feeding unit 11 and serves to supply sheets 25 to the upper reach of the conveyor 17, and for the conveyor 18' which is immediately adjacent to the junction 13 and serves to transport sheets 25 from the conveyor 18 to the upper side of the flexible element 12*a* or from the upper side of the flexible element 12*a* to the upper reach of the conveyor 18. Thus, the conveyors 16, 18, and 18' must be capable of advancing sheets in two different directions but it suffices if the conveyors 17 and 17' are designed to advance sheets 25 in a single direction. The upper reaches of the conveyors 17 and 18 are but need not be exactly parallel to one another.

Figure 3:
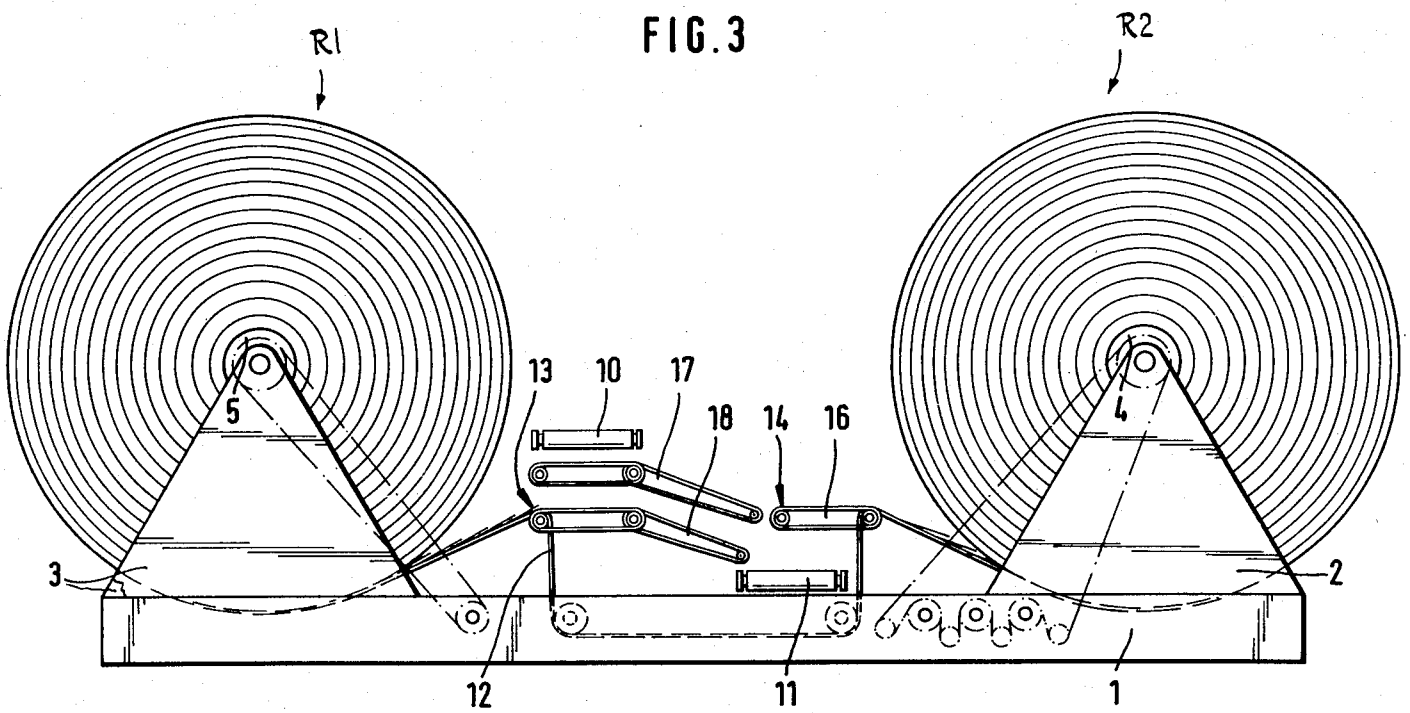
FIG. 3 is a similar elevational view, showing the movable parts of the switchover device in the positions corresponding to those shown in FIG. 1, the apparatus being ready to transport a scalloped stream from the stacking means to the sheet removing means.

FIG. 3 illustrates that stage of operation when the flexible element 12*b* is again convoluted onto the core 4 and confines a supply of sheets 25 which are thus stored in the reservoir R2. When the operator decides to transfer sheets 25 from the device R1 onto the removing unit 11, the core 4 and the hub 5 rotate in a counterclockwise direction whereby the flexible element 12*a* delivers sheets 25 from the spiral path around the hub 5 to the conveyors 18', 18 through the junction 13 and the flexible element 12*a* is then collected by the core 4, i.e., it surrounds the supply of convoluted sheets 25 which are stored in the reservoir R2.

In the scalloped stream which is stored on the core 4 (i.e., in the reservoir R2), the mutual positions of neighboring sheets are satisfactory, i.e., each preceding sheet is partially overlapped by the next-following sheet. As explained above, such positioning of sheets 25 is satisfactory for the transfer from one conveyor onto another conveyor as well as for dumping of successive sheets into a duct, cross-stacker, magazine or the like. The mutual positions of sheets 25 are reversed after completion of transfer of a scalloped stream, which was stored in the reservoir R2, onto the hub 5 in the stacking device R1. In other words, the scalloped stream which is stored in the device R1 is not satisfactory for immediate processing (e.g., for dumping of successive sheets into a duct) because each preceding sheet 25 overlies a part of the respective next-following sheet. However, when the hub 5 is thereupon rotated in a counterclockwise direction to pay out the stored scalloped stream, the mutual positions of sheets 25 in such stream are again satisfactory because the reversal of the direction of travel of the sheets (namely, the travel of sheets from the device R1, through the junction 13, over the conveyors 18' and 18, and onto the upper reach of the conveyor in the removing unit 11) causes each preceding sheet to be partially overlapped by the respective next-following sheet of the scalloped stream advancing from the spiral path around the hub 5 toward and onto the conveyor of the removing unit 11.

When the evacuation of sheets 25 from the spiral path around the hub 5 is completed, the major part of or the entire band 12 is convoluted on the core 4, i.e., the flexible element 12*a* surrounds the flexible element 12*b* which latter cooperates with the core to store a supply of sheets 25 in the reservoir R2. The next step involves reversing the direction of rotation of the core 4 and hub 5 so that the hub 5 first collects the empty flexible element 12*a* and thereupon begins to receive sheets 25 via junction 14, conveyors 18, 18' and junction 13. This is the stage which is shown in FIG. 2. The apparatus is then ready to transfer sheets 25 from the stacking device R1 onto the conveyor of the removing unit 11 while the reservoir R2 receives a fresh supply of sheets 25 from the feeding unit 10.

Figure 5:
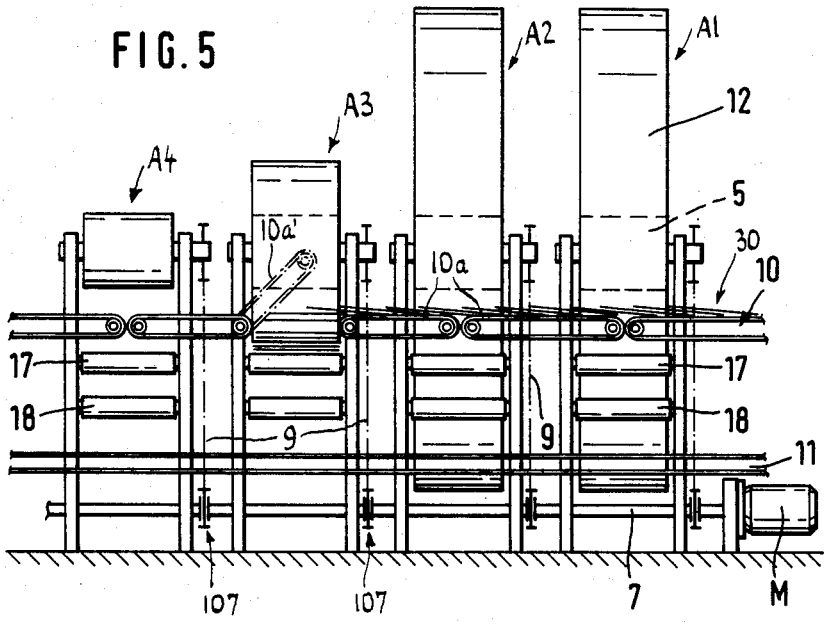
FIG. 5 is an enlarged fragmentary view substantially as seen in the direction of arrows from the line V—V of FIG. 4.
Figure 4:
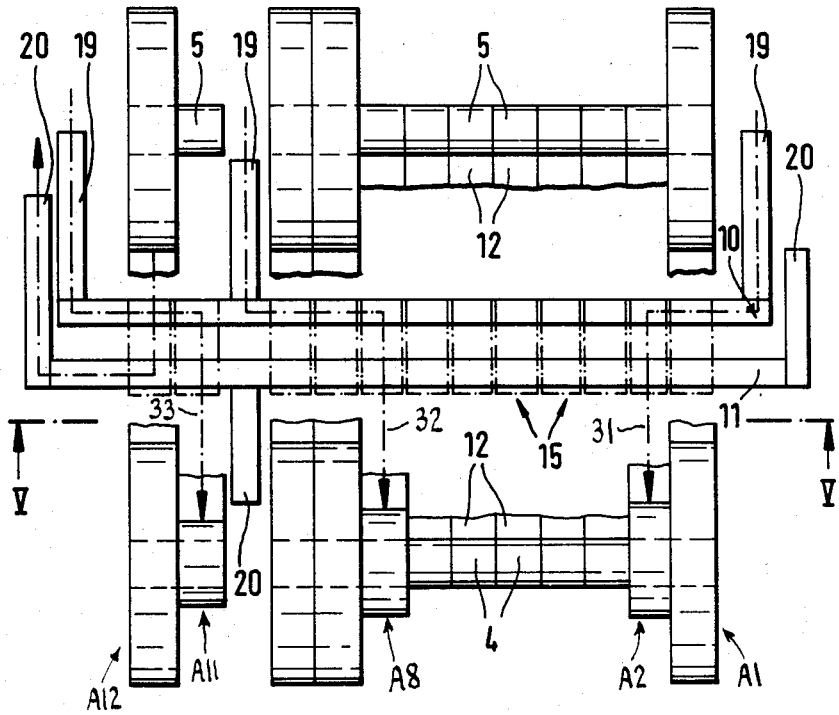
FIG. 4 is a fragmentary schematic plan view of a composite apparatus which comprises a battery of apparatus of the type shown in FIG. 1, and further showing that the feeding means can receive sheets from a plurality of sheet supplying means as well as that the sheet removing means can deliver sheets to a plurality of sheet distributing means.

FIG. 4 is a plan view of a composite apparatus which comprises an entire battery of discrete apparatus of the type shown in FIGS. 1 to 3, for example, a series of twelve neighboring apparatus A1 to A12 each of which includes a stacking device R1 and a reservoir R2. The intermediate portions of the bands 12 in the discrete apparatus (in the regions between the respective reservoirs R2 and the associated stacking devices R1) have been broken away for the sake of clarity. Also, the switchover devices 15 are indicated schematically by phantom lines. It will be noted that a large number of paper sheets can be stored in a very small area, and FIG. 5 further shows that all of the twelve discrete apparatus (only four are actually shown in FIG. 5) can have a common sheet removing unit 11 as well as a common sheet feeding unit 10. These units extend in parallelism with one another, at different levels, and at least the sheet feeding unit 10 comprises several discrete reversible conveyors 10*a* constituting the links of a composite conveyor and each movable to and from an operative position. In FIG. 5, one of the conveyors 10*a* is lifted to a phantom-line inoperative position 10*a'* in which it interrupts the leftward transport of the scalloped stream 30 on the right-hand conveyors 10*a* so that successive sheets 25 of the stream 30 are compelled to descend onto the conveyor 17' in the apparatus A3. The conveyors 10*a* of the sheet feeding unit 10 are reversible so that they can transport sheets 25 in a direction to the left or in a direction to the right, as viewed in FIG. 4 or 5. This sheet feeding unit 10 can cooperate with several (e.g., three) discrete sheet supplying devices 19 each of which can supply a different type of sheets. As indicated in FIG. 4 by a phantom-line arrow 31, the rightmost sheet supplying device 19 can deliver sheets 25 onto the right-hand portion of the feeding unit 10 for delivery to the apparatus A2. A median sheet supplying device 19 can deliver sheets 25 to the apparatus A8 in the direction indicated by the phantom-line arrow 32, and the leftmost sheet supplying device 19 can deliver sheets 25 to the apparatus A11 in the direction indicated by the arrow 33. The apparatus A10 and A11 define a gap for accommodation of one of the sheet supplying devices 19 as well as to accommodate one of several sheet distributing devices 20 each of which can accept sheets from the removing unit 11. FIG. 4 shows three sheet distributing devices 20 each of which can deliver sheets to at least one consumer, e.g., to a gathering machine. The removing unit 11 can also comprise several discrete conveyors corresponding to the conveyors 10*a* and being movable to and from operative positions. This enables the removing unit 11 to accept sheets from any one of the apparatus A1 to A12 for transport to a selected one of the sheet distributing devices 20.

FIG. 5 further shows that the shaft 7 is common to the hubs 5 of all twelve apparatus A1 to A12, and that this shaft carries a discrete coupling means 107 (e.g., a clutch for each of the chain or belt drives 9 so that a selected hub 5 can be driven by the reversible motor M in response to engagement of the corresponding coupling means 107 in a manner not specifically shown and not forming part of the present invention. The same applies for the shaft 6 and the chain or belt drives 8, i.e., each of these drives can receive torque from the shaft 6 through a discrete clutch which can be engaged or disengaged by the attendant or by an automatic programming unit, not shown.

The conveyors of the sheet supplying devices 19 and the conveyors of the sheet distributing devices 20 can receive motion from shafts 21 (see FIG. 1) which are driven by the shaft 6 through the medium of the chain or belt drive 8. The clutches or analogous means for coupling selected devices 19, 20 to the shafts 21 can be indentical with or analogous to the coupling means 107 and are not specifically shown in the drawing.

An important advantage of the improved apparatus or assembly of apparatus is that it or they can store large numbers of sheets in a small area, that such apparatus can deliver sheets in optimum positions to one or more sheet distributing devices (20), and that the space requirements of each apparatus are surprisingly small.

Another important advantage of each of the improved apparatus is its simplicity. This is attributable, at least to a certain extent, to the fact that the construction and mode of operation of the reservoir R2 is or can be identical with those of the respective stacking device R1, i.e., the number of different parts can be reduced significantly by assembling each reservoir from components which are identical with the components of the corresponding stacking device. Another reason for simplicity of the improved apparatus is that the flexible elements 12*a*, 12*b* in each of the apparatus can form part of one and the same elongated flexible band 12. Additional savings in space and additional simplifications of the improved apparatus are achieved in that the core 4 and the hub 5 not only serve as a means for collecting or paying out the respective flexible elements 12*a*, 12*b* but also as component parts of means for temporarily storing substantial quantities of sheets. This obviates the need for discrete sheet storing reels.

A further advantage of the improved apparatus is that each of the hubs 5 is placed above the level of the (first) path defined by the non-convoluted portion of the respective flexible element 12*a*, and that each core 4 is located at a level above the (additional) path which is defined by the non-convoluted portion of the respective flexible element 12*a*. In other words, the sheets 25 are supported and advanced by the upper sides of the flexible elements 12*a*, 12*b* in the regions between the hubs 5 and junctions 13 (flexible elements 12*a*) and in the regions between the cores 4 and junctions 13 (flexible elements 12*b*). Therefore, the improved apparatus need not employ pairs of flexible elements for each of the cores 4 and/or for each of the hubs 5. Such pairs of flexible elements are needed in certain conventional apparatus, e.g., in the apparatus disclosed in German Pat. No. 1,244,656.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for stacking and destacking sheets consisting of paper or the like, comprising sheet feeding means; sheet removing means; sheet stacking means including a hub, a flexible element having an end portion secured to said hub, means for rotating said hub in opposite directions so that the hub can collect and pay out said element, and guide means defining a first path along which a portion of said element advances in response to rotation of said hub; a reservoir; and sheet directing means including means for completing and opening a second path along which the sheets can advance from said feeding means into said reservoir, means for completing and opening a third path along which the sheets can advance from said reservoir into said first path so that said element can convolute the sheets around said hub in response to rotation of the hub in a direction to collect said element, and means for completing and opening a fourth path which connects said first path with said removing means so that the sheets which are convoluted around said hub can be advanced to said removing means in response to rotation of said hub in a direction to pay out said element, said sheet directing means defining a first junction connecting said reservoir with said second path and a second junction connecting said first path with said third path.

2. The apparatus of claim 1, wherein said reservoir comprises a core, a second flexible element having an end portion connected with said core, means for rotating said core in opposite directions so that said core can collect and pay out said second element, and second guide means defining for said second element an additional path communicating with said feeding means in response to completion of and along said second path.

3. The apparatus of claim 2, wherein said second junction is defined by said sheet directing means and the flexible element of said stacking means and said second junction connects said removing means with said first path in response to completion of said fourth path.

4. The apparatus of claim 2, wherein said flexible elements constitute portions of an elongated band and said additional path constitutes an extension of said first path.

5. The apparatus of claim 1, wherein said sheet directing means constitutes a switchover device movable between a first position in which said second and third paths are respectively completed and open and a second position in which said second and third paths are respectively open and completed.

6. The apparatus of claim 1, wherein said hub is disposed at a level above said first path.

7. The apparatus of claim 6, wherein said reservoir comprises a core, a second flexible element having an end portion connected with said core, means for rotating said core in opposite directions so that said core can collect or pay out said second element, and second guide means defining for said second element an additional path communicating with said first path in response to completion of and along said third path, said core being disposed at a level above said additional path.

8. The apparatus of claim 1, wherein said flexible element consists of elastomeric material.

9. The apparatus of claim 8, wherein the elasticity of said flexible element is such that its length is increased by at least one-tenth of one percent, preferably between 0.5 and 1 percent, in response to the application of a tensional stress in the order of between 0.5 and 1.5 $kg/mm^2$, particularly of approximately 1 $kg/mm^2$.

10. The apparatus of claim 1, further comprising a plurality of sheet supplying means each operable to deliver sheets to said feeding means.

11. The apparatus of claim 10, further comprising drive means and means for coupling selected sheet supplying means to said drive means so that the selected sheet supplying means is then operative to deliver sheets to said feeding means.

12. The apparatus of claim 1, further comprising a plurality of sheet distributing means operable to receive sheets from said removing means.

13. The apparatus of claim 12, further comprising drive means and means for coupling selected distributing means to said drive means so that the selected distributing means then receives sheets from said removing means.

14. The apparatus of claim 1, wherein said sheet directing means is disposed intermediate said sheet stacking means and said reservoir and said flexible element forms part of said stacking means.

15. The apparatus of claim 1, wherein said sheet feeding means is arranged to deliver sheets in a first direction and said flexible element is arranged to advance sheets in a second direction substantially at right angles to said first direction.

16. A method of stacking and destacking sheets which consist of paper or the like, comprising the steps of feeding sheets at intervals along a first path; temporarily storing the sheets at a first location including conveying sheets from said first path into a first spiral path wherein the sheets form a succession of convolutions with each next-following convolution surrounding the preceding convolution; temporarily storing the sheets at a second location including conveying the sheets from successive outermost convolutions of said first spiral path into a second spiral path wherein the sheets of said next-following convolutions are surrounded by the sheets of the respective preceding convolutions; and removing the sheets from said second location including conveying sheets from said second spiral path along a further path.

17. The method of claim 16, wherein the sheets in said first spiral path form a first stream in which each next-following sheet partially overlies the preceding sheet, wherein the sheets in said second spiral path form a second stream in which each preceding sheet partly overlies the next-following sheet, and wherein the sheets in said further path form a third stream in which each next-following sheet partially overlaps the preceding sheet.

18. The method of claim 16, further comprising the steps of interrupting the conveying of sheets into said first spiral path during conveying of sheets into said second spiral path, and interrupting the conveying of sheets from said first into said second spiral path during conveying of sheets from said second spiral path into said further path.

* * * * *